US008969269B2

(12) United States Patent
Beret et al.

(10) Patent No.: US 8,969,269 B2
(45) Date of Patent: Mar. 3, 2015

(54) LUBRICATING GREASE COMPOSITION

(75) Inventors: Samil Beret, Danville, CA (US); Gian Lawrence Fagan, Fairfield, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/168,098

(22) Filed: Jun. 24, 2011

(65) Prior Publication Data

US 2012/0329695 A1 Dec. 27, 2012

(51) Int. Cl.

| | |
|---|---|
| ***C07C 55/02*** | (2006.01) |
| ***C08K 5/00*** | (2006.01) |
| ***C10M 169/06*** | (2006.01) |
| ***C10M 169/00*** | (2006.01) |

(52) U.S. Cl.

CPC ..... *C10M 169/06* (2013.01); *C10M 169/00* (2013.01); *C10M 2203/1006* (2013.01); *C10M 2203/1085* (2013.01); *C10N 2210/01* (2013.01); *C10N 2220/022* (2013.01); *C10N 2230/06* (2013.01); *C10N 2230/08* (2013.01); *C10N 2230/26* (2013.01); *C10N 2240/02* (2013.01); *C10N 2250/10* (2013.01); *C10M 2203/1065* (2013.01); *C10M 2207/1256* (2013.01)

USPC ..... 508/506; 508/212

(58) Field of Classification Search

CPC ..... C10M 117/04; C10M 169/045; C10M 171/00

USPC ..... 508/212, 506

See application file for complete search history.

(56) References Cited

U.S. PATENT DOCUMENTS

| | | | | |
|---|---|---|---|---|
| 3,833,500 | A | 9/1974 | Carter et al. | |
| 4,053,424 | A * | 10/1977 | Coleman | 508/375 |
| 5,110,489 | A * | 5/1992 | Stadler et al. | 508/236 |
| 5,731,274 | A | 3/1998 | Andrew | |
| 7,111,989 | B1 * | 9/2006 | Cook et al. | 384/462 |
| 7,544,645 | B2 | 6/2009 | Miller et al. | |
| 7,871,967 | B2 | 1/2011 | Miller et al. | |
| 2008/0318819 | A1 * | 12/2008 | Saita et al. | 508/463 |
| 2009/0088353 | A1 * | 4/2009 | Berry et al. | 508/388 |
| 2009/0247437 | A1 * | 10/2009 | E. et al. | 508/362 |

OTHER PUBLICATIONS

American Society for Testing and Materials (ASTM) Test Method D2596 "Standard Method for Measurement of Extreme-Pressure Properties of Lubricating Grease (Four-Ball Method)" Aug. 27, 1982.

* cited by examiner

*Primary Examiner* — Prem C Singh
*Assistant Examiner* — Francis C Campanell
(74) *Attorney, Agent, or Firm* — Terrence Flaherty; Jeffrey McQuiston

(57) ABSTRACT

A lubricating grease composition for extreme pressure applications requiring extended lubrication intervals comprises a major amount of a lubricating base oil; a lithium complex thickener; and a polar compound selected from the group consisting of a rust inhibitor, a non-ionic surfactant, and mixtures thereof; wherein the concentration of the polar compound in the lubricating grease composition is no more than 0.5 wt. %, based on the total weight of the lubricating grease composition.

11 Claims, No Drawings

LUBRICATING GREASE COMPOSITION

TECHNICAL FIELD

This application generally relates to lubricating grease compositions for extreme pressure applications requiring extended lubrication intervals.

BACKGROUND

Over the years, the heavy-duty trucking market has adopted the diesel engine as its preferred power source due to both its excellent longevity and its economy of operation. Recently, the specifications for heavy-diesel engines indicate a longer interval between oil changes than has been customary in the past. For the user of commercial vehicles such as cross-country freight carriers, extended lubrication intervals (30,000 miles, $4.8\times10^4$ km, or more) mean more on-the-road time and a greater rate of return on the investment as well as decreased maintenance costs.

Specialized lubricants have been developed to meet the more stringent performance requirements of heavy-duty diesel engines compared to passenger car engines. Lubricating greases are employed in a wide range of applications where heavy pressures exist, including wheel bearing, chassis, steering drag links, king pins, transmission cross shaft spring pins, shackle pins, brake cam shafts, and fifth wheel faceplates and pivots operating under high and low temperature conditions.

Extended lubrication intervals using currently available greases have led to driver complaints of hard steering. Also, high wear has been observed on king pins, shackles, and ball and steering knuckle joints. The cause of high wear in these areas appeared to be due to salt corrosion. This salt corrosion caused deep pitting of the metal surfaces and also plugged lubrication ducts, thus accelerating wear due to the lack of lubrication. Currently available greases do not provide the necessary degree of rust protection of the lubricated parts for long service interval use.

In addition, greases with poor water wash-off or water repellency decrease the longevity of the grease and increase wear on the surface being lubricated. Greases which come in contact with water often harden and sometimes separate from the parts to be lubricated. In the hardened condition, these greases do not work their way back into the parts to be lubricated. Since the grease hardens and separates from the parts to be lubricated, it no longer seals out water, dirt or salt which can cause abrasive wear and rusting.

Another problem encountered with currently available greases is that they are not work-stable. In other words, they do not stay put on the lubricated parts, thus leaving the parts without lubrication, and allowing for only short service intervals before the grease must be replenished. Currently available greases also tend to be displaced under shock loading conditions. Shock loading conditions to the entire steering system can occur, for example, when a wheel hits a bump in the road. The sudden shock tends to force the lubricated parts together, squeezing the grease out from between them. On a commercial vehicle, one such point subject to shock loading is the fifth wheel. If a severe bump is hit, shock loading can occur, leading to subsequent binding of this pivot point.

A grease which will meet the requirements for extended lubrication intervals for such vehicles must not only have the above described characteristics, but must also have appropriate high and low temperature properties. In other words, the grease should not soften and run under operating conditions encountered in warmer climates, and yet, should as well exhibit good low temperature pumpability in colder climates.

Due to ever increasing demands for higher performance, it would be desirable to provide greases which exhibit improved lubrication properties, and in particular, improved water protection performance and wear protection performance along with increased grease lifetime.

SUMMARY

In one aspect, we provide a lubricating grease composition comprising a major amount of a lubricating base oil; a lithium complex thickener; and a polar compound selected from the group consisting of a rust inhibitor, a non-ionic surfactant, and mixtures thereof; wherein the concentration of the polar compound in the lubricating grease composition is no more than 0.5 wt. %, based on the total weight of the lubricating grease composition.

In another aspect, we provide a method of making a lubricating grease composition which comprises blending together: a major amount of a lubricating base oil; a lithium complex thickener; and a polar compound selected from the group consisting of a rust inhibitor, a non-ionic surfactant, and mixtures thereof; wherein the concentration of the polar compound in the lubricating grease composition is no more than 0.5 wt. %, based on the total weight of the lubricating grease composition.

In yet another aspect, we provide a method of lubricating bearings, surfaces and other lubricated components comprising use of a lubricating grease composition which comprises a major amount of a lubricating base oil; a lithium complex thickener; and a polar compound selected from the group consisting of a rust inhibitor, a non-ionic surfactant, and mixtures thereof; wherein the concentration of the polar compound in the lubricating grease composition is no more than 0.5 wt. %, based on the total weight of the lubricating grease composition.

DETAILED DESCRIPTION

Oil of Lubricating Viscosity

The lubricating grease composition comprises a major amount of a lubricating base oil. As used herein, the term "major amount" refers to a concentration of the base oil within the lubricating grease composition of at least about 50 wt. %. The amount of base oil in the lubricating grease composition ranges from 50 to 95 wt. %, typically from 55 to 90 wt. %, and often from 60 to 85 wt. %, based on the total weight of the lubricating grease composition.

The base oil can be of mineral origin, synthetic origin, vegetable origin, animal origin, or a combination thereof. Base oils of mineral origin can be mineral oils, for example, those produced by solvent refining or hydroprocessing. Base oils of synthetic origin can typically comprise mixtures of $C_{10}$ to $C_{50}$ hydrocarbon polymers, ester type polymers, ether type polymers, and combinations thereof. Suitable examples of synthetic oils include polyolefins such as alpha-olefin oligomers and polybutene; polyalkylene glycols such as polyethylene glycol and polypropylene glycol; diesters such as di-2-ethylhexyl sebacate, di-2-ethylhexyl adipate, or those disclosed in U.S. Pat. No. 7,871,967; triesters such as those disclosed in U.S. Pat. No. 7,544,645; polyol esters such as trimethylolpropane ester and pentaerythritol ester; perfluoroalkyl ethers; silicone oils; polyphenyl ethers; either individually or as mixed oils. Base oils can also include Fischer-Tropsch derived base oils.

In one embodiment, the base oil is a mineral oil. Examples of suitable mineral oils include heavy neutral oil, bright stock, naphthenic base oil and mixtures thereof.

In one embodiment, the base oil is a high viscosity base oil having a kinematic viscosity at 40° C. greater than 100 $mm^2/s$. In another embodiment, the base oil is a blend of different high viscosity base oils, with the different base oils all having a kinematic viscosity at 40° C. greater than 100 $mm^2/s$.

In one embodiment, the base oil has a kinematic viscosity at 40° C. from 30 $mm^2/s$ to 600 $mm^2/s$; in another embodiment, from 100 $mm^2/s$ to 300 $mm^2/s$; and in yet another embodiment, from 175 $mm^2/s$ to 275 $mm^2/s$.

Complex Soap Thickener

In addition to the base oil, the lubricating grease composition comprises a thickener system comprising a lithium soap of a $C_{12}$ to $C_{24}$ hydroxy carboxylic acid and a lithium soap of a $C_2$ to $C_{12}$ dicarboxylic acid.

Suitable $C_{12}$ to $C_{24}$ hydroxy carboxylic acids can include 12-hydroxystearic acid, 12-hydroxyricinoleic acid, 12-hydroxybehenic acid and 10-hydroxypalmitic acid. In one embodiment, the $C_{12}$ to $C_{24}$ hydroxy fatty acid is 12-hydroxystearic acid.

The $C_2$ to $C_{12}$ dicarboxylic acid can be a $C_4$ to $C_u$, or a $C_6$ to $C_{10}$, aliphatic dicarboxylic acid. Suitable $C_2$ to $C_{12}$ dicarboxylic acids include oxalic acid, malonic acid, succinic acid, glutaric acid, adipic acid, suberic acid, pimelic acid, azelaic acid, dodecanedioic acid and sebacic acid. In one embodiment, azelaic acid or sebacic acid is used.

In one embodiment, the amount of lithium complex thickener in the lubricating grease composition ranges from 2 to 30 wt. %, from 5 to 20 wt. %, or 10 to 15 wt. %, based on the total weight of the lubricating grease composition.

Polar Compound

The lubricating grease composition also comprises a polar compound selected from the group consisting of a rust inhibitor, a non-ionic surfactant, and mixtures thereof. Rust inhibitors and non-ionic surfactants can be highly polar compounds and, therefore, can exhibit a strong affinity for water in grease. By removing or reducing the content of at least one of these polar compounds from the formulation, the water resistance of greases can be improved significantly. Improved water resistance can result in improved product adherence.

Examples of rust inhibitors include stearic acid and other fatty acids; dicarboxylic acids; metal soaps; fatty acid amine salts; metal salts of heavy sulfonic acid; phosphoric esters; amine phosphates; (short-chain) alkenyl succinic acids, partial esters thereof and nitrogen-containing derivatives thereof; synthetic alkaryl sulfonates (e.g., metal dinonylnaphthalene sulfonates); and the like and mixtures thereof.

Examples of non-ionic surfactants include polyoxyalkylene agents (e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate), partial carboxylic acid esters of polyhydric alcohols (e.g., glycerin fatty acid esters, sorbitan fatty acid esters, pentaerythritol fatty acid esters) and the like and mixtures thereof.

Non-ionic surfactants can assist in solubilizing the lithium complex thickener precursors, increasing the rate of thickener formation. Applicants have found that the rate of lithium complex thickener formation in the lubricating grease composition was adequate without an amount of surfactant greater than about 0.5 wt. %, or even without any surfactant.

The amount of the polar compound in the lubricating grease composition is no more than 0.5 wt. %, e.g., from 0.01 to 0.5 wt. %, based on the total weight of the lubricating grease composition. In other embodiments, the amount of the polar compound in the lubricating grease composition ranges from 0.01 to 0.45 wt. %; or from 0.01 to 0.4 wt. %; or from 0.01 to 0.35 wt. %; or from 0.01 to 0.3 wt. %; or from 0.01 to 0.25 wt. %; from 0.01 to 0.2 wt. %, based on the total weight of the lubricating grease composition.

Extreme Pressure Agent

In one embodiment, the lubricating grease composition further comprises at least one extreme pressure agent.

Examples of an extreme pressure agent include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and mono-unsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof.

When used, the amount of the extreme pressure agent in the lubricating grease composition can range from 0.25 to 5.0 wt. %, or from 0.5 to 2.5 wt. %, based on the total weight of the lubricating grease composition.

Optional Additives

Various other grease additives can be incorporated into the lubricating grease composition, in amounts sufficient to impart the desired effects (e.g., oxidation stability, tackiness, etc.). Suitable additives include fungicides and antibacterial agents; colorants; shear stability additives; anti-wear/anti-weld agents; flame retardants such as calcium oxide; oiliness agents; corrosion inhibitors such as alkali metal nitrite, e.g. sodium nitrite; oil bleed inhibitors such as polybutene; foam inhibitors such as alkyl methacrylate polymers and dimethyl silicone polymers; oxidation inhibitors such as hindered phenols or amines, for example phenyl alpha naphthylamine; metal deactivators such as disalicylidene propylenediamine, triazole derivatives, thiadiazole derivatives, mercaptobenzimidazoles; complex organic nitrogen, and amines; friction modifiers; thermal conductive additives; electroconductive agents; elastomeric compatibilizers; viscosity modifiers such as polymethacrylate type polymers, ethylene-propylene copolymers, styrene-isoprene copolymers, hydrated styrene-isoprene copolymers, polyisobutylene, and dispersant type viscosity modifiers; pour point depressants such as polymethyl methacrylate; multifunctional additives such as sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound and the like. Solid materials such as graphite, finely divided molybdenum disulfide, talc, metal powders, and various polymers such as polyethylene wax can also be added to impart special properties.

Properties

In one embodiment, the grease composition exhibits excellent water protection performance. In one sub-embodiment, the water protection performance is determined according to ASTM D1264-11 ("Standard Test Method for Determining the Water Washout Characteristics of Lubricating Greases") wherein the resistance of a lubricating grease to washout by water from a bearing is evaluated at 79° C. In one embodiment, the grease composition has an average grease wash out of less than 4.0 wt. %; in another embodiment, less than 3.5 wt. %. In another sub-embodiment, the water protection performance is determined according to ASTM D4049-06

("Standard Test Method for Determining the Resistance of Lubricating Grease to Water Spray") wherein the ability of a grease to adhere to a metal surface when subjected to a water spray at 40 psi (276 kPa) and 38° C. is evaluated. Exposed parts, such as fifth wheels, are subject to water spray. In one embodiment, the grease composition has an average water spray off of less than 20 wt. %, in another embodiment, less than 18 wt. %; and in yet another embodiment, less than 15 wt. %.

In one embodiment, the grease composition exhibits excellent extreme pressure properties as measured using ASTM D2596-10 ("Standard Test Method for Measurement of Extreme-Pressure Properties of Lubricating Grease (Four-Ball Method)"). In this test, the load carrying properties of lubricating greases are evaluated. The Load Wear Index (LWI) is a measure of the ability of a lubricant to prevent wear at applied loads. The greater the index, the better potential load property of the grease. This test approximates the shock loading resistance of components like fifth wheels and chassis. In one embodiment, the lubricating grease composition has a Load Wear Index rating of at least 65; in another embodiment, at least 70; in yet another embodiment, at least 75; in still yet another embodiment, at least 80.

In one embodiment, the grease composition exhibits excellent bearing life, i.e., it is capable of performing for longer periods of time at high temperatures/speeds as compared to currently available extended service heavy duty greases. In one embodiment simulating the high temperature stability of the grease in an automotive wheel bearing and in a modified automotive front wheel hub-spindle-bearings assembly (ASTM D3527-07 "Standard Test Method for Life Performance of Automotive Wheel Bearing Grease"), the grease composition has a bearing life of at least 150 hours; in another embodiment, a bearing life of at least 175 hours; and in yet another embodiment, a bearing life of at least 200 hours.

In one embodiment, the grease composition exhibits excellent low temperature torque properties as measured according to ASTM D4693-07 ("Standard test Method for Low-Temperature Torque of Grease-Lubricated Wheel Bearing"). The test determines the extent to which a test grease retards the rotation of a specially-manufactured, spring-loaded, automotive-type wheel bearing assembly when subjected to low temperatures. Torque values, calculated from restraining-force determinations, are a measure of the viscous resistance of the grease. In this test, lower torque numbers correspond to better performance of the grease at low temperatures. In one embodiment, the grease composition has a maximum torque of 30 N-m at −40° C.; in another embodiment, a maximum torque of 28 N-m at −40° C.; in yet another embodiment, a maximum torque of 26 N-m at −40° C.

The pumpability performance of the grease composition at low temperature (−22° F.) was evaluated using the Lincoln Ventmeter Test method as described in "The Lubrication Engineers Manual," 3rd Edition, Association for Iron & Steel Technology, pp. 156-157, 2007. This test evaluates the ability of a grease to flow through a centralized lube system at lower temperatures.

EXAMPLES

The following examples are given to illustrate the present invention. It should be understood, however, that the invention is not to be limited to the specific conditions or details described in these examples.

Example 1

Several greases were prepared and tested as set forth in Table 1. Grease A, which demonstrates good adherence characteristics necessary in providing for extended service intervals, has a high base oil viscosity of 383 $mm^2/s$ resulting in poor low temperature pumpability. Inventive Grease 1 was designed to a) improve water resistance by removing the non-ionic surfactant that is typically used for the formulation of the lithium complex thickener and reducing the amount of rust inhibitor and b) improve the low temperature handling by reducing the base oil viscosity. Both greases were prepared from highly refined, high viscosity mineral oil base oils.

TABLE 1

| | Test Method | Grease 1 | Grease A |
|---|---|---|---|
| Component | | | |
| Mineral Oil Base Oils (wt. %) | | 67.2 | 64.7 |
| Li complex thickener (wt. %) | | 12.1 | 13.7 |
| Rust inhibitor (wt. %) | | 0.2 | 1.0 |
| Non-ionic surfactant (wt. %) | | — | 0.1 |
| EP, anti-wear and other additives (wt. %) | | 20.5 | 20.5 |
| Properties | | | |
| NLGI Grade | | 2 | 2 |
| Base Oil Vis. @ 40° C. ($mm^2/s$) | ASTM D445 | 261 | 383 |
| Dropping Point (° C.) | ASTM D2265 | 233 min. | 265 |
| Penetration Test | ASTM D217 | 275 to 295 | 280 |
| Water Spray Off (wt. %) | ASTM D4049 | 13.2 | 28.1 |

As shown, inventive Grease 1 had significantly improved water resistance and much lower base oil viscosity over Grease A.

Example 2

Inventive Grease 1 was then compared against several commercial extended service heavy duty greases (Grease B and Grease C) in a number of standard performance tests. The results are set forth in Table 2.

TABLE 2

| | Test Method | Grease 1 | Grease B | Grease C |
|---|---|---|---|---|
| Properties | | | | |
| NLGI Grade | | 2 | 2 | 2 |
| Thickener Type | | Li Complex | Li Complex | Li Complex |
| Base Oil Type | | Mineral Oil | Mineral Oil | Mineral Oil |
| Base Oil Vis. @ 40° C. ($mm^2/s$) | ASTM D445 | 261 | 160 | 288 to 352 |
| Dropping Point (° C.) | ASTM D2265 | 233 min. | 245 | 260 |
| Penetration Test | ASTM D217 | 275 to 295 | 270 | 265 to 295 |
| Water Washout (wt. %) | ASTM D1264 | 3.0 | 4.3 | 6.3 |
| Water Spray Off (wt. %) | ASTM D4049 | 13.2 | 23.8 | 53.1 |
| Load Wear Index | ASTM D2596 | 80.0 | 35.5 | 50.0 |
| Wheel Bearing Life (h) | ASTM D3527 | 180 | 100 | 28 |
| Low Temp. Torque (N-m) | ASTM D4693 | 26.4 | 29.1 | 40.9 |
| Pumpability @ −22° F. (psi) | Lincoln Ventmeter | 1450 | 1480 | 1760 |

In comparison to other extended service heavy duty greases, inventive Grease 1 demonstrated superior water protection performance as evidenced in the water washout and water spray off tests; superior wear performance as evidenced in the load wear index test; superior long-life performance as evidenced in the wheel bearing life test; and comparable, or better, low temperature performance as evidenced by the low temperature torque test and by the low temperature pumpability test.

The term "comprising" means including elements or steps that are identified following that term, but any such elements or steps are not exhaustive, and an embodiment can include other elements or steps. For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal language of the claims. To an extent not inconsistent herewith, all citations referred to herein are hereby incorporated by reference.

The invention claimed is:

1. A lubricating grease composition comprising:

a) a major amount of a lubricating base oil;

b) a lithium complex thickener; and c) a polar compound selected from the group consisting of a rust inhibitor, a non-ionic surfactant, and mixtures thereof;

wherein the concentration of the polar compound in the lubricating grease composition is no more than 0.5 wt. %, based on the total weight of the lubricating grease composition, and wherein the grease has a bearing life of at least 150 as determined by ASTM D3527-07 and a load wear index rating of at least 80 as determined by ASTM D2596-10.

2. The lubricating grease composition of claim 1, wherein the grease has an average grease wash out of less than 4 wt. % as determined by ASTM D1264-11.

3. The lubricating grease composition of claim 1, wherein the grease has an average water spray off of less than 20 wt. % as determined by ASTM D4049-06.

4. The lubricating grease composition of claim 1, wherein the grease has a maximum torque of 30 N-m at −40° C. as determined by ASTM D4693-07.

5. The lubricating grease composition of claim 1, wherein the base oil has a kinematic viscosity at 40° C. from 175 $mm^2/s$ to 275 $mm^2/s$.

6. The lubricating grease composition of claim 1, wherein the concentration of the polar compound in the lubricating grease composition ranges from 0.01 to 0.25 wt. %, based on the total weight of the lubricating grease composition.

7. The lubricating grease composition of claim 1, wherein the concentration of the lithium complex thickener in the lubricating grease composition ranges from 2 to 30 wt. %, based on the total weight of the lubricating grease composition.

8. The lubricating grease composition of claim 1, further comprising at least one extreme pressure agent.

9. A method of making a lubricating grease composition which comprises blending together:

a) a major amount of a lubricating base oil;

b) a lithium complex thickener; and c) a polar compound selected from the group consisting of a rust inhibitor, a non-ionic surfactant, and mixtures thereof;

wherein the concentration of the polar compound in the lubricating grease composition is no more than 0.5 wt. %, based on the total weight of the lubricating grease composition, and wherein the grease has a bearing life of at least 150 hours as determined by ASTM D3527-07 and a load wear index rating of at least 80 as determined by ASTM D2596-10.

10. A method of lubricating bearings, surfaces and other lubricated components comprising use of a lubricating grease composition which comprises:

a) a major amount of a lubricating base oil;

b) a lithium complex thickener; and c) a polar compound selected from the group consisting of a rust inhibitor, a non-ionic surfactant, and mixtures thereof;

wherein the concentration of the polar compound in the lubricating grease composition is no more than 0.5 wt. %, based on the total weight of the lubricating grease composition.
wherein the grease has a bearing life of at least 150 hours as determined by ASTM D3527-07 and a load wear index rating of at least 80 as determined by ASTM D2596-10.

11. A lubricating grease composition comprising:

a) a major amount of a lubricating base oil;

b) a lithium complex thickener; and c) a polar compound selected from the group consisting of a rust inhibitor, a non-ionic surfactant, and mixtures thereof;

wherein the concentration of the polar compound in the lubricating grease composition is no more than 0.5 wt. %, based on the total weight of the lubricating grease composition.
wherein the grease has a bearing life of at least 150 hours as determined by ASTM D3527-07 and a load wear index rating of at least 80 as determined by ASTM D2596-10, and wherein the base has a kinematic viscosity at 40° C. from 175 $mm^2/s$ to 275 $mm^2/s$.

* * * * *